US007273342B2

(12) United States Patent
DeSilvio

(10) Patent No.: US 7,273,342 B2
(45) Date of Patent: Sep. 25, 2007

(54) BOOM EXTENSION FOR A CONSTRUCTION VEHICLE

(75) Inventor: John DeSilvio, Voorhees, NJ (US)

(73) Assignee: DeSilvio & Co., Inc., Cedar Brook, NJ (US)

( * ) Notice: Subject to any disclaimer, the term of this patent is extended or adjusted under 35 U.S.C. 154(b) by 104 days.

(21) Appl. No.: 11/213,091

(22) Filed: Aug. 26, 2005

(65) Prior Publication Data

US 2006/0239809 A1 Oct. 26, 2006

Related U.S. Application Data

(60) Provisional application No. 60/674,361, filed on Apr. 22, 2005.

(51) Int. Cl.
*B66C 23/00* (2006.01)

(52) U.S. Cl. ..... 414/722; 414/680

(58) Field of Classification Search ..... 414/680, 414/685, 722, 724, 723, 686, 718; 212/177
See application file for complete search history.

(56) References Cited

U.S. PATENT DOCUMENTS 4,571,146 A * 2/1986 Eriksson ..... 414/687
5,611,657 A * 3/1997 Peterson ..... 414/722
6,119,377 A * 9/2000 Rubio ..... 37/403

* cited by examiner

*Primary Examiner*—Donald Underwood
(74) *Attorney, Agent, or Firm*—Stuart M. Goldstein

(57) ABSTRACT

A non-articulated boom extension is designed to be attached to the moveable support arm of a skid steer loader or similar construction vehicle, to increase both horizontal and vertical reach capabilities of the vehicle. The boom extension is formed with two longitudinally extending rigid arm members which are immoveably connected at an obtuse angle in relation to each other. An intermediate support section is secured to both arms to maintain a rigid connection, thus insuring that the extender, at all times, maintains this advantageous configuration. The boom extension has a base at the end of one of its arm members which allows the extension to be pivotally connected for angular adjustment with the support arm of the vehicle. At the other end of the boom extension, there is a connection for attaching an auger, hook, or other work-related apparatus.

7 Claims, 2 Drawing Sheets

BOOM EXTENSION FOR A CONSTRUCTION VEHICLE

RELATED U.S. APPLICATION DATA

Related provisional application 60/674,361 was filed on Apr. 22, 2005.

BACKGROUND OF THE INVENTION

Construction vehicles, such as skid steer loaders, all-wheel steer loaders, compact track loaders, and the like provide a wide range of uses in the construction trades. Such vehicles normally employ moveable support arms with the ability to use various attachments, which allow work to be done a given distance away the vehicle itself. For instance, when using a skid steer loader with an auger apparatus used to dig holes, the actual operation takes place a number of feet from the front end of the loader. However, if there is a need to auger holes over and beyond an obstruction, e.g. a guide-rail, fence, or concrete curb, this arrangement may render the auger attachment useless, since the support arm of the loader cannot reach far enough over the obstruction or barrier to allow the use of the auger. As a practical matter, when augering larger diameter holes using a standard skid steer loader, there is a risk of collapse induced by vibrations or movement of the loader. The moveable support arms of loaders are also restricted, by their lengths, from reaching far ahead of the loader body itself and over higher fences or barriers. The support arms on standard loaders also cannot reach vertical heights above which work must be done.

SUMMARY OF THE INVENTION

It is thus the object of the present invention to overcome the disadvantages and limitations inherent in the use of loader construction vehicles.

It is an object of the present invention to provide a boom extension for a construction vehicle which increases the versatility and functionality of the vehicle.

It is another object of the present invention to provide a boom extension for a construction vehicle which is designed to facilitate access to areas previously inaccessible to construction vehicles, such as skid steer loaders and other construction equipment designed to accept loader attachments.

It is a further object of the present invention to provide a boom extension for a construction vehicle which provides a greater radius of operation for construction vehicles and thus access to areas previously unreachable.

It is still another object of the present invention to provide a boom extension for a construction vehicle which allows construction vehicles, like skid steer loaders, to reach over walls or other obstructions to auger holes, move, position and place equipment and material, and generally increase the versatility and usefulness of the vehicle.

It is another object of the present invention to provide a boom extension for a construction vehicle which reduces the risk of damage to obstructions or barriers.

It is a further object of the present invention to provide a boom extension for a construction vehicle which reduces the risk of excavation collapse due to vibrations or movement of the construction vehicle, allowing the operator of the vehicle to operate at a distance which will reduce the risk of collapse in the work area.

It is still another object of the present invention to provide a boom extension for a construction vehicle which eliminates the cost of additional machinery, setup, and transportation in order to auger holes and do other work in areas otherwise inaccessible to such vehicles.

It is still another object of the present invention to provide a boom extension for a construction vehicle which eliminates the risk of rollover by allowing the operator to position the construction vehicle on stable or level ground while using the present invention to reach the unnavigable site.

It is further object of the present invention to provide a boom extension for a construction vehicle which allows the option of adding lift hook and other attachment apparatus for positioning objects.

It is another object of the present invention to provide a boom extension for a construction vehicle which generally expands both the vertical and horizontal reach capabilities of the construction vehicle.

These and other objects are accomplished by the present invention, a non-articulate boom extension designed to be attached to the moveable support arm of a skid steer loader or similar construction vehicle, to increase both horizontal and vertical reach capabilities of the vehicle. The boom extension is formed with two longitudinally extending rigid arm members which are immoveably connected at an obtuse angle in relation to each other. An intermediate support section is secured to both arms to maintain a rigid connection, thus insuring that the extender, at all times, maintains this advantageous configuration. The boom extension has a base at the end of one of its arm members which allows the extension to be pivotally connected for angular adjustment with the support arm of the vehicle. At the other end of the boom extension, there is a connection for attaching an auger, hook, or other work-related apparatus.

The novel features which are considered as characteristic of the invention are set forth in particular in the appended claims. The invention, itself, both as to its design, construction, and use, together with additional features and advantages thereof, are best understood upon review of the following detailed description with reference to the accompanying drawings.

DETAILED DESCRIPTION OF THE INVENTION

Figure 1:
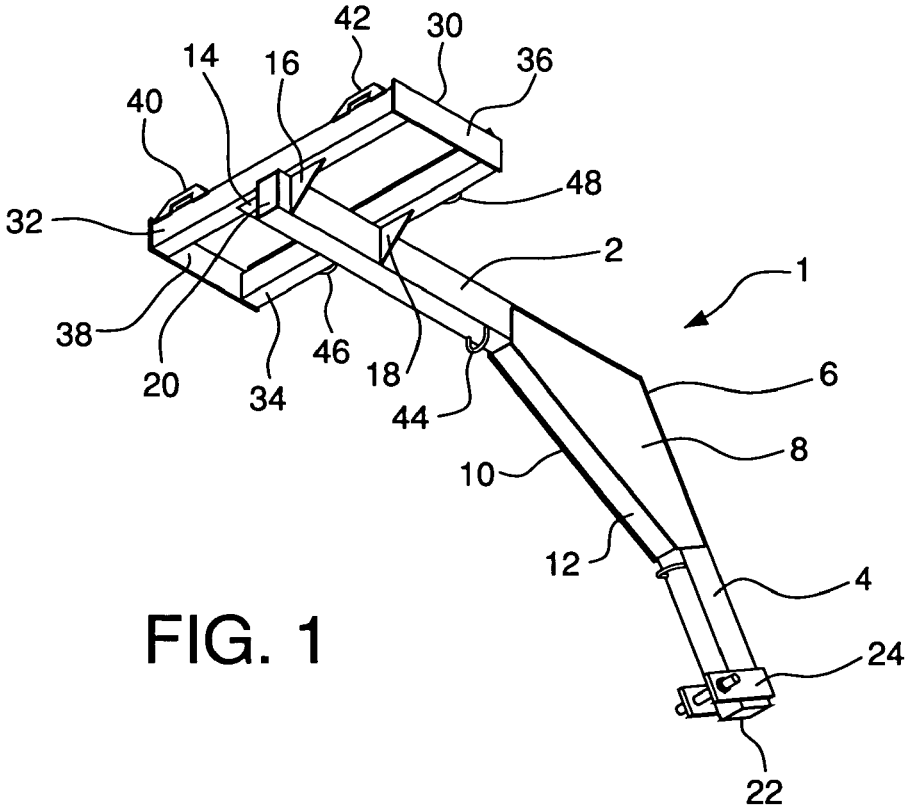
FIG. 1 is an isometric view of the boom extension of the present invention.
Figure 2:
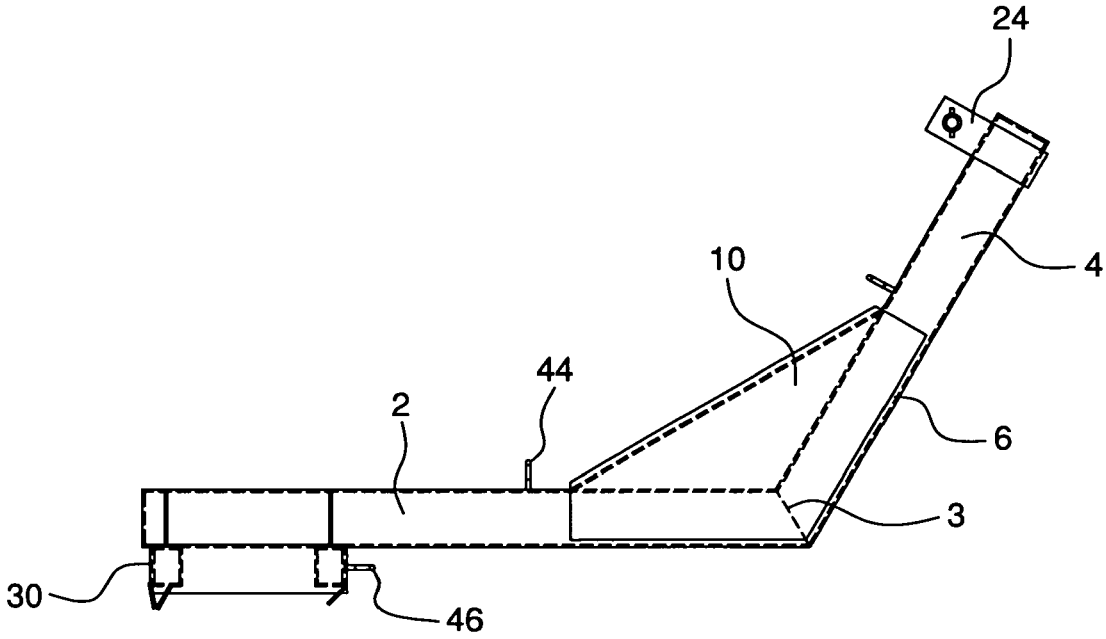
FIG. 2 is a side view of the boom extension of the present invention.

Boom extension 1 of the present invention is a non-articulated unit comprising a longitudinally extending first arm member 2 connected at 3 by welding or equivalent securing means to longitudinally extending second member 4. Arm members 2 and 4 are secured at an obtuse angle in relation to each other, thus advantageously forming a configuration which allows for maximum, efficient reach of boom extension 1. Arm members 2 and 4 are made of rigid A36 carbon steel or other suitable high strength material.

Intermediate section 6 of boom extension 1 comprises substantially triangular shaped gusset plates 8 and 10 secured by welding or equivalent means to arm members 2 and 4. Strut plate 12 is positioned at a right angle and between gusset plates 8 and 10, each end of the strut plate being secured to arm members 2 and 4. Intermediate support section 6 thus provides the necessary rigidity to maintain the advantageous obtuse angular configuration of boom extension 1. Additional reinforcement is provided by the attachment of smaller support plates 14, 16, and 18. Arm members 2 and 4 as shown, are tubular in configuration and, when this configuration is employed, end caps 20 and 22 are provided to prevent entry of moisture and unwanted debris into the members. However, this invention is not to be considered limited by the shape or construction of arm members 2 and 4. Arm members can be constructed of any equivalent shape or material which provides the boom extension its requisite strength and rigidity.

Yoke 24 is secured to the end of arm member 4 and this connection provides a means for the attachment of augers, hooks, and other loader equipment attachments.

Base member 30 is rectangular in configuration. It comprises base supports 32 and 34 secured together by cheek plates 36 and 38. Latch plates 40 and 42 are secured to base member 30 to allow angular, pivotable adjustment of boom extension 1 in relation to the moveable support arm of the construction vehicle in use. Latch plates 40 and 42 pivotably connect base member 30 to the support arm by means of pins which extend from the arm through the latch plates. Hose control rings 44, 46 and 48 are provided to keep hydraulic hoses safely positioned on boom extension 1.

Figure 3:
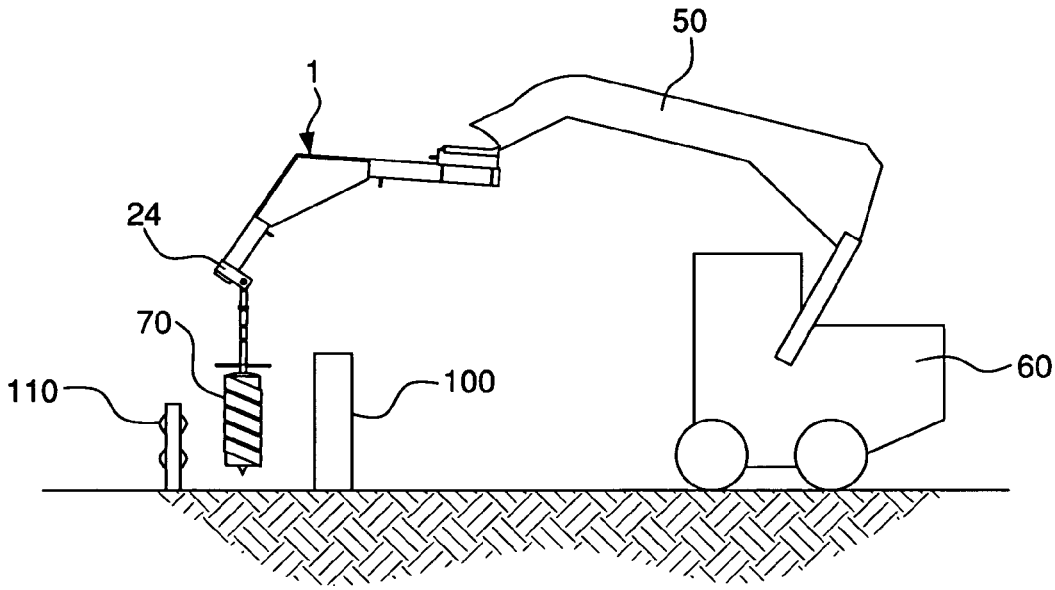
FIG. 3 is a view of the boom extension of the present invention connected to a construction vehicle and with auger attachment.

FIG. 3 shows boom extension 1 pivotally attached to moveable support arm 50 of construction vehicle 60. Auger apparatus 70 is secured to yoke 24 of the boom extension. It thus can be seen that vehicle 60 with boom extension 1, can gain access to areas otherwise inaccessible, e.g. over or between walls, fences, rails or other upstanding obstructions 100 and 110, as shown in FIG. 3.

Figure 4:
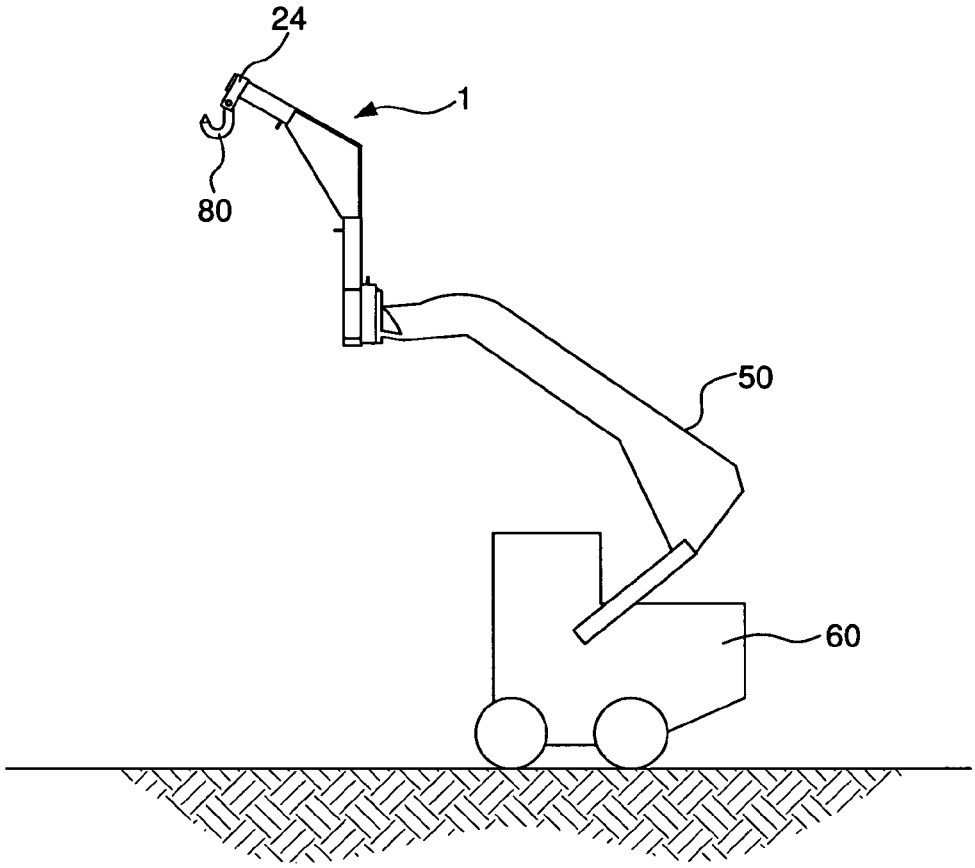
FIG. 4 is a view of the boom extension of the present invention connected to a construction vehicle shown as for use in vertical height operations.

FIG. 4 shows boom extension 1 in use to reach vertical heights and with hook 80 connected to yoke 24 for lifting equipment and material.

It is thus seen that the boom extension of the present invention provides added versatility to skid steel loaders or other types of construction vehicles, enabling the vehicles to increase both their horizontal and vertical reach capabilities. The boom extension allows these vehicles to secure augers or lift hooks or similar work-related attachment means to access areas and distances otherwise well beyond standard loader vehicle capabilities. The boom extension also provides increased access to areas inaccessible due to obstructions such as guide rails or walls.

Certain novel features and components of this invention are disclosed in detail in order to make the invention clear in at least one form thereof. However, it is clearly to be understood that the invention as disclosed is not necessarily limited to the exact form and details as disclosed. Since it is apparent that various modifications and changes may be made without departing from the spirit of the invention.

The invention claimed is:

1. A boom extension system for a construction vehicle, said system comprising:

a support arm extending out from and pivotably connectable at a first end to the body of a construction vehicle and, at a second end, connected to a boom extension, said boom extension comprising a rigidly formed unitary body having a longitudinally extending first section with a longitudinally extending top surface, a longitudinally extending second section, and an intermediate support section, said first section being immovably connected to and extending from one end of the intermediate support section, said second section being immovably connected to and extending from a second end of the intermediate support section, the first section and the second section being connected to the intermediate support section such that the sections extend from the intermediate support section at an obtuse angle in relation to each other, said boom extension further comprising a base member extending over and secured onto the top surface of the first section, said base member having latching means for pivotably connecting the base member to the support arm to adjust the angle of the boom extension in relation to the support arm;

a work-related apparatus; and means to secure the second section to attachment means for connecting the work-related apparatus to the boom extension.

2. The boom extension system as in claim 1 wherein the first and second sections comprise elongated rigid components interconnected at ends of the sections.

3. The boom extension system as in claim 1 wherein the intermediate support section comprising dual gusset plates secured to the first and second sections.

4. The boom extension system as in claim 1 wherein the means to secure the second section comprises a connecting yoke assembly.

5. The boom extension system as in claim 1 whereby the boom extension can be pivotally positioned to access locations which cannot be accessed solely by the support arm of the construction vehicle.

6. The boom extension system as in claim 1 whereby the boom extension is pivotable upwards to access areas above the construction vehicle otherwise not accessible to the support arm.

7. The boom extension system as in claim 1 wherein the first section, the second section, and the intermediate support section form a non-articulated arm unit.

* * * * *